US010081462B2

(12) United States Patent
Largacha et al.

(10) Patent No.: US 10,081,462 B2
(45) Date of Patent: Sep. 25, 2018

(54) OVERCAP WITH MEANS TO FACILITATE THE OPENING OF A CONTAINER AND THE SUBSEQUENT DIRECT CONSUMPTION OF ITS CONTENT

(71) Applicant: DANONE ALQUERIA S.A.S., Bogotá (CO)

(72) Inventors: Claudia Largacha, Bogotá (CO); Adriana Wolff, Bogotá (CO)

(73) Assignee: DANONE ALQUERIA S.A.S., Bogota (CO)

( * ) Notice: Subject to any disclaimer, the term of this patent is extended or adjusted under 35 U.S.C. 154(b) by 44 days.

(21) Appl. No.: 15/277,281

(22) Filed: Sep. 27, 2016

(65) Prior Publication Data

US 2017/0015473 A1 Jan. 19, 2017

Related U.S. Application Data

(63) Continuation of application No. PCT/CO2015/000004, filed on Mar. 26, 2015.

(30) Foreign Application Priority Data

Mar. 28, 2014 (CO) ..... 14-066.742

(51) Int. Cl.
*B65D 43/02* (2006.01)
*B65D 47/06* (2006.01)
(Continued)

(52) U.S. Cl.
CPC ..... *B65D 47/065* (2013.01); *B65D 43/0202* (2013.01); *B65D 43/0214* (2013.01);
(Continued)

(58) Field of Classification Search
CPC .. B65D 47/065; B65D 43/0202; B65D 51/22; B65D 43/0214; B65D 51/185; B65D 2543/00046
(Continued)

(56) References Cited

U.S. PATENT DOCUMENTS 3,912,128 A * 10/1975 Ziemann ..... B65D 47/10 222/541.6
4,059,201 A * 11/1977 Foster ..... B65D 51/20 220/258.2
(Continued)

FOREIGN PATENT DOCUMENTS

WO 90/14280 A1 11/1990

*Primary Examiner* — James N Smalley
(74) *Attorney, Agent, or Firm* — Baker & Hostetler LLP

(57) ABSTRACT

This invention discloses an innovative device to effectively open a recipient or container whose cap is formed by a laminated surface, also forming a mouthpiece that allows the direct and hygienic consumption of the content within. The disclosed device is an overcap comprising: i) a base with an inner hollow space, and ii) a tab located within the hollow space of the base, having piercing and cutting means on one of its ends and comprising an inner hollow space; which is connected to the base by means of two end pieces forming an axis for the tab to be turned. Once said overcap is coupled with the container, the laminated surface can be pierced and removed/pulled away by turning the tab, thereby creating an opening in the laminate allowing the content to exit there from. The tab completes its turn when the end opposite to the one containing the piercing and cutting means reaches the base of the cap, in such a way that a mouthpiece is formed, thereby facilitating the direct and hygienic consumption of the content within a container whose cap is formed by a laminated surface, ensuring no contact between the mouth of the consumer and the container or its cap, and with no spills or splashes.

7 Claims, 8 Drawing Sheets

Figure 1:
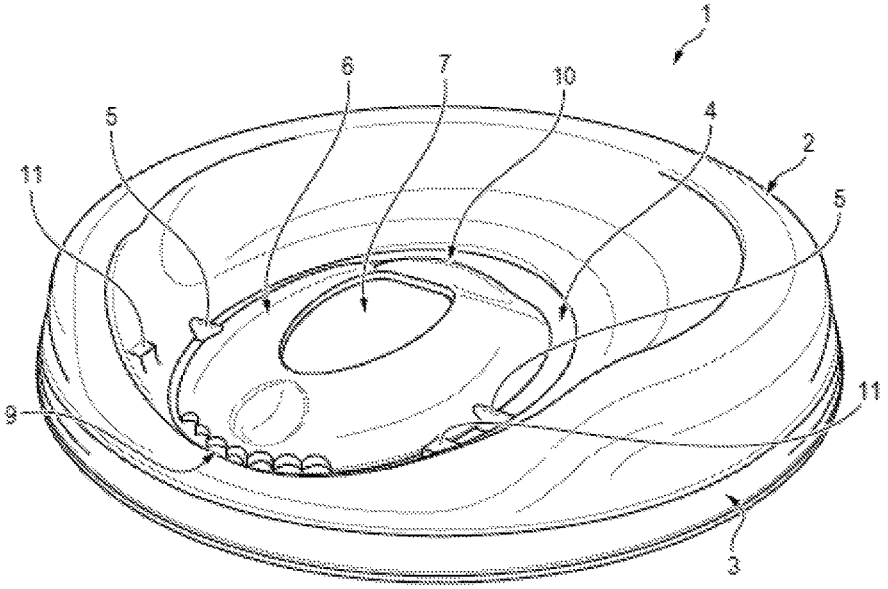

(51) Int. Cl.
*B65D 51/18* (2006.01)
*B65D 51/22* (2006.01)

(52) U.S. Cl.
CPC ..... *B65D 51/185* (2013.01); *B65D 51/22* (2013.01); *B65D 2543/00046* (2013.01)

(58) Field of Classification Search
USPC ..... 220/277, 278, 254.3
See application file for complete search history.

(56) References Cited

U.S. PATENT DOCUMENTS

| | | | | | |
|---|---|---|---|---|---|
| 4,350,260 | A | | 9/1982 | Prueher | |
| 4,934,590 | A | * | 6/1990 | Robichaud | B65D 5/748 229/125.09 |
| 5,101,999 | A | * | 4/1992 | Robichaud | B65D 5/748 220/258.4 |
| 5,833,112 | A | * | 11/1998 | Pape | B65D 5/748 220/258.2 |
| 5,947,316 | A | * | 9/1999 | Guillonnet | B65D 5/748 220/269 |
| 6,164,488 | A | | 12/2000 | Solland et al. | |
| 6,612,456 | B1 | | 9/2003 | Hundley et al. | |
| 7,028,863 | B1 | * | 4/2006 | Taylor | B65D 5/748 222/153.14 |
| 7,628,296 | B2 | * | 12/2009 | Rudolph | B29C 45/0017 220/265 |
| 2012/0228295 | A1 | * | 9/2012 | Emircan | B65D 5/747 220/254.1 |
| 2014/0319184 | A1 | * | 10/2014 | Emircan | B65D 51/1683 222/483 |
| 2016/0185493 | A1 | * | 6/2016 | Cox | B65D 47/065 220/278 |

* cited by examiner

OVERCAP WITH MEANS TO FACILITATE THE OPENING OF A CONTAINER AND THE SUBSEQUENT DIRECT CONSUMPTION OF ITS CONTENT

CROSS REFERENCE TO PRIOR APPLICATIONS

This application is a continuation of International Application No. PCT/CO2015/000004, filed Mar. 26, 2015 and designating the U.S., which claims priority to Colombian Patent Application No. 14-066.742, filed Mar. 28, 2014, both of which are incorporated herein by reference in their entirety.

The present invention comprises an overcap to effectively open containers sealed with a laminated surface, such as yogurt, avena, kumis and juices containers among others, forming a mouthpiece so the content of such container may be consumed directly in a hygienic manner. In this way, when the device of the invention is coupled with the sealed container, the laminate film which seals such container is pierced by turning the tab, creating an opening in the laminated surface and thus allowing the content to exit there from. In this sense, the tab completes its turn when the end of the tab that is not equipped with piercing and cutting means reaches the base of the cap, forming a mouthpiece to facilitate the direct consumption of the content therein.

BACKGROUND OF THE INVENTION

As it is well known, a wide range of recipients are used within the ready-to-eat food sector for packaging purposes such as, aluminium cans for drinks, multi layer/stackable boxes or containers or bottle or cup-style recipients, which are generally made from various types of plastic and all of which incorporate varying closure elements.

Amongst this range of containers are those recipients whose cap is formed by a laminated surface. Such containers are popular given their appropriate resistance and protection capacity, which facilitates and eases the closure process in addition to being low-cost.

This type of closure, which employs a laminated surface, is designed specifically to be easy to use and open on the part of the consumer. However, it is apparent that a good design cannot prevent the inconveniences that occur when the final user opens the container.

To this regard, the most common inconveniences that occur upon opening the film incorrectly are; the increase in the probability of product spillage and the generation of sharp fragments of the laminate on the mouth-support area, resulting in accidents such as cuts to the mouth or fingers of the user, among others.

Taking into account these possible inconveniences, it is well known that many consumers have the habit of opening the laminated surface partially to consume this type of products by forming an exit hole for the content and thereby preventing the foregoing incidents. However, the size and quality of such exit hole depends on the user's skills and the force applied upon opening the cap. Furthermore, by only partially opening the laminated surface, the content residue on the underneath of said laminated surface is exposed and the consumer may smear the product on their nose when bringing the container up to their mouth.

In addition to the foregoing, it must be taken into account that before reaching the final consumer, these various containers are handled throughout various stages of which the following can be highlighted: packaging, receiving and display of such products in storage points. All such handling stages mean that the body and edges of the containers, including the laminated surface, are inevitably contaminated.

Contaminating agents present on the container could inevitably be transferred to the consumer upon contact between the consumer's mouth and the upper edge of the container.

To this regard, the packaging industry has developed a series of elements, with the main purpose of protecting the areas on these containers that necessarily come into direct contact with the consumer upon consumption of the product packaged therein.

Taking the aforementioned into consideration, it must be pointed out that, in the case of recipients such as the aluminium can, flexible hood-type caps have been developed to protect the edges of such containers and additionally provide a support area for the mouth of the consumer.

What's more, in the case of the said aluminium cans, the patent document ES1068714 discloses a mechanism that facilitates consumption of content and prevents contact between the mouth of the consumer and the areas of the container exposed to contamination.

Likewise, in the case of cup-type containers that are sealed with laminated seals, concave hard overcaps have been designed to prevent contamination, as in the case of the aluminium cans. That is to say, that such overcaps are coupled with the container before the container is dispatched from its place of manufacture. In this way, it is only separated from the container when its content is going to be consumed.

However, the use of hard caps increases product-packaging costs, and on the other hand, this type of cap only ensures protection if it is coupled with the container in the place of manufacture, that is to say, before the container is subject to any contamination.

On the other hand, even though such caps provide protection in both a mechanical and hygienic manner, it is clear that they unfortunately do not comprise any benefits that prevent the above-mentioned inconveniences upon opening the container, such as spills, splashes and accidents due to sharp fragments left on the rim of the container.

In light of the foregoing, the necessity in the state of the art to develop a device which allows for containers whose cap is formed by a laminated surface to be effectively opened, thereby reducing inconveniences such as splashes and spills and furthermore preventing direct contact between the mouth of the consumer and a likely contaminated surface, in such a way that the content may exit the container in a direct and hygienic manner, is more than apparent.

BASIC DESCRIPTION OF THE INVENTION

Thus, taking into account that learnt in the above referenced state of the art and the need for a consumer to be able to hygienically consume the content of a container whose cap is formed by a laminated surface, the applicant of the patent in question has developed an innovative device, hereinafter referred to as the overcap, which allows for a recipient or container whose cap is formed by a laminated surface to be effectively opened, forming a mouthpiece for the direct and hygienic consumption of the content contained therein.

In this sense, the overcap of this present invention comprises: i) a base with an inner hollow space and ii) a tab located within the inner hollow space of the base, having piercing and cutting means on one of its ends and comprising an inner hollow space; which is connected to the base by means of two end pieces forming an axis for the tab to be turned.

Before the overcap is coupled with the container to be opened, the position of the tab is such that its end comprising the piercing and cutting means is located so it is facing the section of the laminate to be pierced.

Once the overcap has been coupled to the container, the rotation of the tab allows to pierce the laminated surface of the container by sliding it and thereby forming an opening in the laminate in order to remove the contents. Thus, the tab turns completely when the end opposite to the one containing the piercing and cutting means reaches the base of the overcap to form a mouthpiece which facilitates direct consumption of said container contents.

This innovative overcap allows for the direct and hygienic consumption of the content of a container whose cap is formed by a laminated surface, ensuring no contact between the mouth of the consumer and the container or its cap, and with no spills or splashes.

DETAILED DESCRIPTION OF THE INVENTION

In addition to that already outlined herein, the object of this present application and the technical advantages achieved by the inventor can be appreciated in detail in the following description of the overcap to effectively open a recipient whose cap is formed by a laminated surface, as illustrated in to the appended drawings wherein:

FIG. 1 is an overhead view of the overcap disclosed in this present invention wherein said overcap comprises: i) a base with an inner hollow space and ii) a tab located in the hollow space of the base having piercing and cutting means on one of its ends and comprising a hollow inner space; which is connected to the base by means of two end pieces forming an axis for the tab to be turned.

Figure 2:
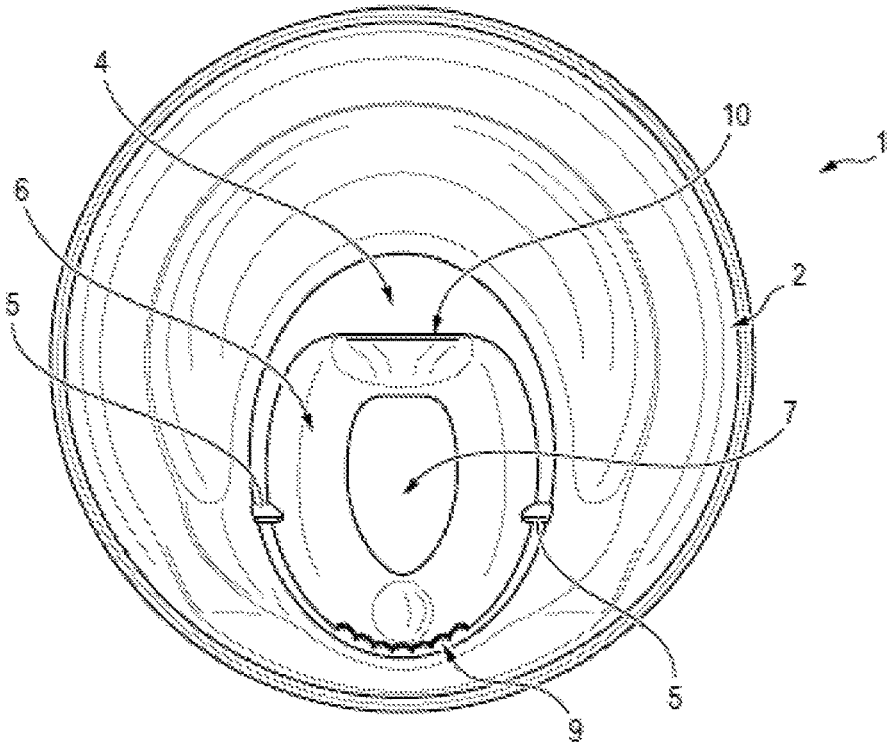

FIG. 2 corresponds to an overhead view of the overcap of this present invention.

Figure 3:
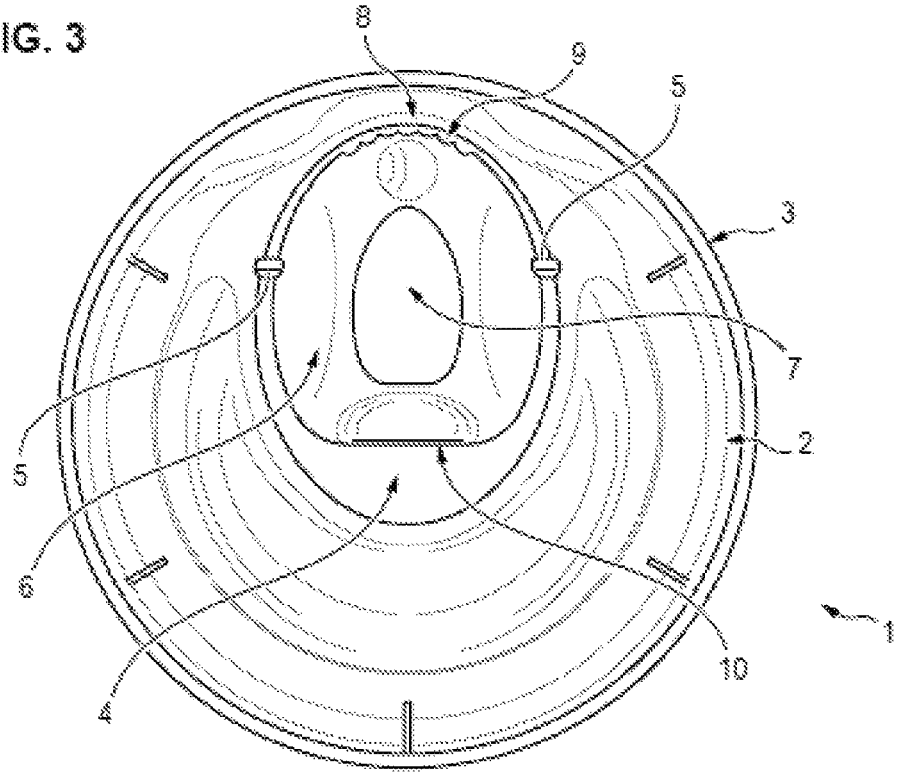

FIG. 3 is the bottom view of the overcap of the present invention.

Figure 4:
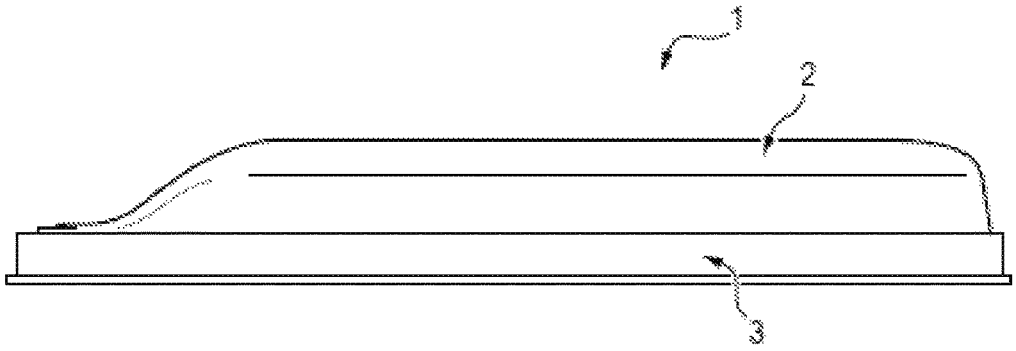

FIG. 4 corresponds to the lateral right view of the overcap of this present invention.

Figure 5:
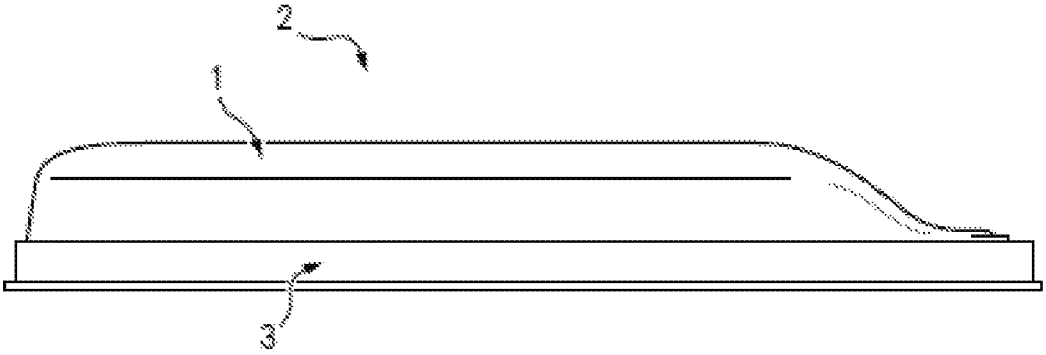

FIG. 5 corresponds to the lateral left view of the overcap of this present invention.

Figure 6:
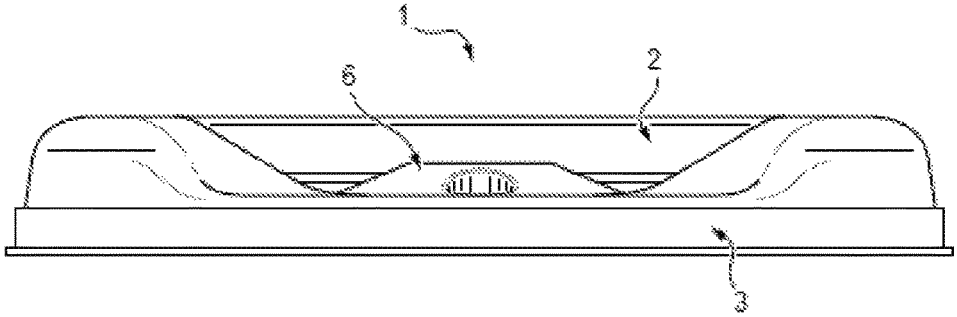

FIG. 6 corresponds to the front view of the overcap of this present invention.

Figure 7:
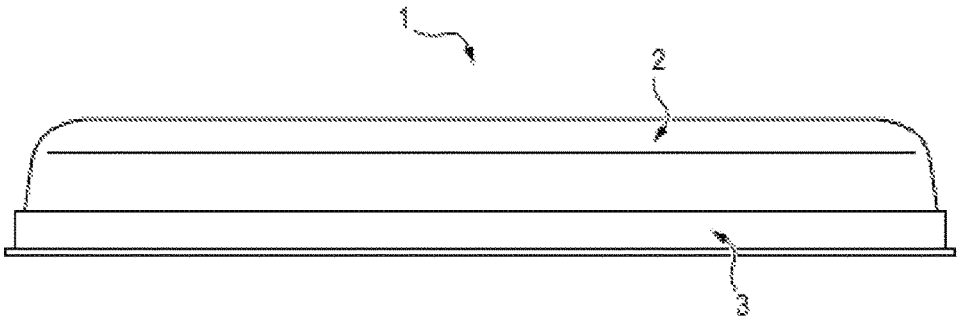

FIG. 7 corresponds to the rear view of the overcap of this present invention.

Figure 8A:
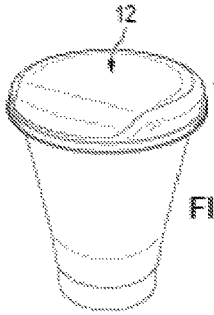

FIG. 8 is the perspective view of a recipient comprising an embodiment of the overcap in accordance with present invention, wherein the position of the device can be observed when opening the recipient:

FIG. 8*a* corresponds to the perspective view of a recipient comprising an embodiment of the overcap in accordance with this present invention, which includes a protective cap.

Figure 8B:
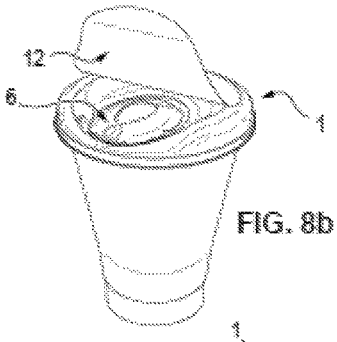

FIG. 8*b* corresponds to the recipient of FIG. 8*a*, wherein the protective cap has been partially removed.

Figure 8C:
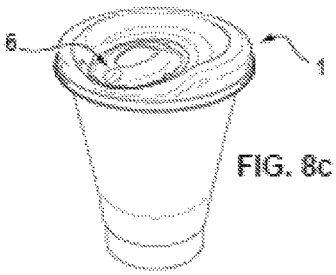

FIG. 8*c* corresponds to the recipient of FIG. 8*a*, wherein the protective cap has been completely removed and therefore the overcap is in its initial position, that is to say before opening the container.

Figure 8D:
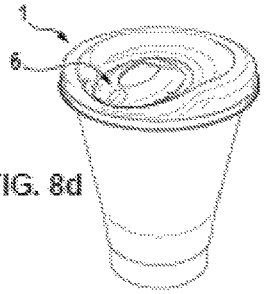

FIG. 8*d* corresponds to the recipient of FIG. 8*a*, wherein the tab has been partially turned towards the laminated surface.

Figure 8E:
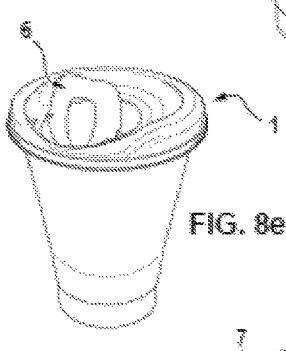

FIG. 8*e* corresponds to the recipient of FIG. 8*a*, wherein the tab has pierced the laminated surface and such laminated surface has been partially cut with the purpose of forming an opening for content to exit.

Figure 8F:
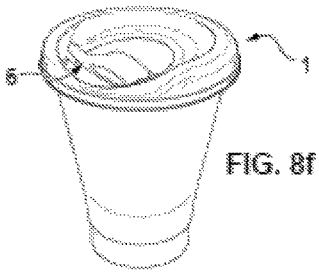

FIG. 8*f* corresponds to the recipient of FIG. 8*a*, wherein the tab has completely formed an opening for content to exit the recipient.

Figure 8G:
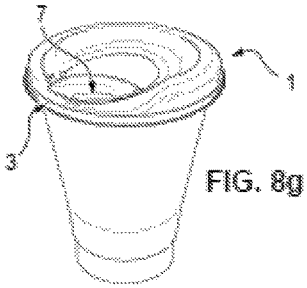

FIG. 8*g* corresponds to the recipient of FIG. 8*a*, wherein the tab has completed its turn, in such a way that the opening for the food has been completely formed and the laminated surface has been completely removed, in such a way that as the tab reaches the base of the overcap a mouthpiece is formed for the hygienic consumption of the content.

Thus, in reference to FIGS. 1 to 7 of the application, the device or overcap (1) disclosed in this present invention comprises: i) a base (2) with an inner hollow space (4), and ii) a tab (6) located in the hollow space of the base (4), which is connected to the base (2) by means of two end pieces (5) forming an axis for the tab (6) to be turned.

As represented by figures, the end pieces (5) are preferably located laterally, approximately at mid-length of the tab (6). From the formed axis over which the tab (6) turns, are defined a first end (a proximal end), close to the outer edge of the base (2), and a second end (a distal end), close to the centre of the base (2). Said second end is end (10) in figures.

One of the edges (the first end) of such tab (6) has piercing (8) and cutting (9) means and the tab has an inner hollow space (7).

Likewise and in accordance with FIGS. 8*c* to 8*g* of the application, once the overcap (1) is coupled with the container (FIG. 8*c*), the laminated surface of the container can be pierced (FIGS. 8*d* and 8*e*) and pulled away (FIG. 8*f*) by turning the tab, thereby creating an opening in the film for the content to exit there from. In this way, the turning action of the tab (6) is complete when the edge (10) opposite to the one containing the piercing (8) and cutting (9) means reaches the base (2) (FIG. 8*g*), in such a way that a mouthpiece is formed facilitating the direct consumption of the content therein.

As it will be explained below, the turn of the tab (6) is preferably performed by pulling said second end of the tap (6) upwards, i.e. by spacing the second end from the laminated surface of the container. Because of the mid-length location of the end pieces (5), the pulling of the second end causes the rear side of the first end to press the laminated surface and pierce it.

Therefore, the disclosed overcap (1) allows for a container whose cap is formed by a laminated surface to be effectively opened, thereby reducing inconveniences such as splashes and spills and, which furthermore prevents direct contact between the mouth of the consumer and a most likely contaminated surface, in such a way that the content of the container may be directly consumed in a hygienic manner on the part of the consumer.

In an embodiment of the present invention, the base (2) of the overcap (1) may be of any size, thickness and geometrical shape, in such a way that it may be coupled to any type of container or recipient whose cap is formed by a laminated surface. Therefore, in a specific embodiment of the invention, the size, thickness and geometrical shape of said base (2) are such that a tab (6) can be fitted in the hollow space of the base (4), wherein the film is opened by turning such tab (6) which pierces and pulls the laminate away, forming a mouthpiece for the direct and hygienic consumption of the content therein.

In another embodiment of the present invention, the base (2) comprises a rim (3).

In another embodiment, the rim (3) of the base (2) may be of any width and height provided that the overcap (1) can be attached to the recipient to be opened, thereby preventing spills and allowing content to exit there from via a place other than the hollow space (7).

In another embodiment, the hollow space (4) and the connecting end pieces (5) may be of any geometrical shape and configuration, provided that the tab (6) can be freely turned. Therefore, in a specific embodiment, the hollow space (4) is oval in shape and the connecting end pieces (5) are configured to fix the tab (6) to the base (2), and at the same time, allow it to be moved freely.

In another embodiment, the tab (6) may be of any shape, thickness or geometrical shape, in such a way that it may be coupled to the hollow space (4) of the base (2) using the connecting end pieces (5); wherein said tab (6) comprises an inner hollow space (7), which may be of any size and geometrical shape, provided that content can exit the container, and air can enter the container. Preferably, the tab (6) is a thin piece, the hollow space (7) traversing the tab (6) in the thickness. In addition, one of the ends of said tab (6) comprises means for piercing (8) and cutting (9).

Therefore, in a specific embodiment and in accordance with FIGS. 1 to 3, the tab (6) is concave (slightly concave, so as to have a globally flat shape) and the hollow space (7) is oval in shape. Because of the hollow space (7), the tab (6) has preferably sensibly a flat ring shape. The piercing means (8) on the underside of the tab (6) comprise one or more sharp protruding points and the cutting means (9) are formed by the corrugation of the tab (6) edge, in such a way that upon turning the tab (6) in the direction of the laminated surface, the piercing means (8) pierce said surface and the cutting means (9) subsequently make the opening already formed by the piercing means (8) larger and pull the laminate away from the container cap, thereby forming an opening from which the content of the container can exit.

In another yet more specific embodiment and in accordance with FIG. 3, the piercing means (8) on the underside of the tab (6) comprise a sharp protruding element.

The end (10) opposite to the end containing the piercing (8) and cutting (9) means is the second end mentioned above. As explained, this is a handling end, i.e. the end of the tab (6) to be grasped by a consumer and pulled so as to initiate spinning of the tap (6) and piercing the laminated surface of the container.

In an additional embodiment and in accordance with FIGS. 1 and 2, the surface of said end (10) of the tab (6) opposite to the end containing the piercing (8) and cutting (9) means is convex, thereby facilitating contact between the mouth of the consumer and the overcap when consuming the content of the container. The convex surface at the same time facilitates a finger of the consumer to insert under this end (10), i.e. to insert between the tap (6) and the laminated surface of the container. Consequently, it makes easier for the consumer to pull the end (10) of the tab (6) and to open the container. The concave surface of the second end (10) therefore makes the overcap (1) at the same time ergonomic, efficient and hygienic, while keeping a very simple design.

In another embodiment, the second end (10) of the tab (6) opposite to the end containing the piercing (8) and cutting (9) means comprises holding elements which attach the tab (6) to the base (2) when it completes its turn; wherein said tab (6) is fixed to the base (2) making it even easier to consume the content of the container.

In another embodiment, an overcap (1) is disclosed in this present invention, wherein the base (2), the connecting end pieces (5) and the tab (6) comprise one single integral piece. Therefore, the two end pieces (5) are unmoving pieces (for example cylindrical pins, as represented) which are twisted when the tab (6) is spun.

In another embodiment and in accordance with FIGS. 1 and 2, the outer side of the base (2) of the overcap (1) additionally comprises support elements (11) which support the tab (6) when it completes its turn, thereby forming a mouthpiece (FIG. 8*g*) for the direct consumption of the content therein.

In particular, the support elements (11) advantageously secure the tab (6) with the base (2), so as to press the tab (6) against the rim (3). It prevents beverage to leak between them when the tab (6) is secured by the support elements (11), especially when the second end (10) present a convex shape: the mouthpiece forms a perfect nozzle for direct hygienic consumption of said packed content without any risks of splashes or leaks.

In another embodiment, in accordance with FIGS. 8*a* and 8*b*, the above referenced overcap (1) is disclosed in this present invention, wherein it also comprises a protective cap (12), which is attached to the overcap (1) to thereby prevent contamination of said overcap (1), wherein said protective cap may be of any material.

In another embodiment, a recipient is disclosed in the present invention, which comprises the above referenced overcap (1) whose cap is formed by a laminated surface, wherein said recipient may be of any size and volume and in addition the overcap (1) is attached to the recipient with tape or plastic wrapping.

Finally, in the present invention a method is disclosed for the consumption of content within a container whose cap is formed by a laminated surface, wherein said method comprises the following steps: a) couple the overcap (1) with the container whose cap is formed by a laminated surface; b) turn the tab (6) so that the piercing (8) and cutting (9) means pierce and pull away the laminated surface of the container forming an opening in the surface; c) turn the tab (6) completely so that the end (10) opposite to the one containing the piercing (8) and cutting (9) means reaches the base (2) (with which it can be secured by the supporting elements (11)); and finally d) consume the content of the container using the mouthpiece formed (in particular formed by the convex surface of the end (10)).

The disclosed overcap and recipient may be manufactured using any material that does not react with the content contained therein, preferably using polymeric materials, and more preferably using polypropylene and/or polyethylene, and even more preferably in an integral way.

What is claimed is:

1. An overcap which allows for a container to be effectively opened in addition to forming a mouth piece for the direct consumption of its content, characterized in that it comprises:

i) a base that comprises:
   A). an inner hollow space, and
   B). a rim, ii) a concave tab located in the hollow space, which comprises:
   A). an inner hollow space having an oval shape;
   B). two end pieces by means of which the concave tab is connected to the base and form a horizontal axis on which said tab rotates;
   C). a first end (a proximal end) close to an outer edge of the base, which comprises a piercing and cutting means, wherein the piercing means is on an underside of the concave tab, and the cutting means are formed by a corrugation of the edge of the tab; and D). a second end (a distal end) that is convex and close to a center of the base, which comprises holding elements to attach the concave tab to the base when it ends its rotation.

2. The overcap according to claim 1, characterized in that an upper side of the base further comprises support elements which support the second end of the tab when it ends its rotation, forming a mouthpiece.

3. The overcap according to claim 1, characterized in that it further comprises a protective cap attached to the overcap.

4. The overcap according to claim 1, manufactured using polymeric materials, more preferably polypropylene and/or polyethylene.

5. A recipient characterized in that it comprises:

i) the overcap according to claim 1, and ii) a cap formed by a laminated surface.

6. A recipient according to claim 5, wherein the overcap is attached to the recipient using tape or plastic wrapping.

7. A method for the consumption of the content of a recipient, wherein said method comprises the following steps:

A) provide a recipient including:

a) a cap formed by a laminated surface, and b) an overcap comprising:

i) a base that comprises:

an inner hollow space, and a rim, and ii) a concave tab located in the hollow space of the base that comprises:

an inner hollow space having an oval shape, two end pieces by means of which the concave tab is connected to the base and form a horizontal axis on which said tab rotates, a first end (a proximal end) close to an outer edge of the base, which comprises a piercing and cutting means, wherein the piercing means is on an underside of the concave tab, and the cutting means are formed by a corrugation of the edge of the tab, and a second end (a distal end) that is convex and close to a center of the base, which comprises holding elements to attach the concave tab to the base when it ends its rotation;

B) rotate the tab of the overcap so that the piercing and cutting means pierce and pull away the cap of the recipient forming an opening in the surface, and finish its rotation when the distal end touches the support elements in the base;

C) attach the tab to the base; and

D) finally consume the content of the container using the mouthpiece formed after rotation of the tab.

* * * * *